United States Patent [19]

Wolter

[11] 4,377,082

[45] Mar. 22, 1983

[54] CYLINDER-LOCK WITH FLAT KEY

[75] Inventor: Heinz Wolter, Kürten, Fed. Rep. of Germany

[73] Assignee: DOM-Sicherheitstechnik GmbH & Co. KG, Brühl, Fed. Rep. of Germany

[21] Appl. No.: 206,924

[22] Filed: Nov. 14, 1980

[30] Foreign Application Priority Data

Nov. 24, 1979 [DE] Fed. Rep. of Germany ..... 2947402

[51] Int. Cl.[3] ..... E05B 19/08; E05B 19/12; E05B 27/10

[52] U.S. Cl. ..... 70/364 A; 70/395; 70/398; 70/409

[58] Field of Search ..... 70/364 A, 395, 398, 70/399, 402, 405, 406, 409, 411, 358

[56] References Cited

U.S. PATENT DOCUMENTS 828,480 8/1906 Ibbott et al. ..... 70/411
1,333,887 3/1920 Warren ..... 70/395
1,382,826 6/1921 Dove ..... 70/395
1,735,868 11/1929 Klingel ..... 70/421
3,877,267 4/1975 Harris ..... 70/411

FOREIGN PATENT DOCUMENTS 739473 9/1943 Fed. Rep. of Germany ..... 70/395

*Primary Examiner*—Robert L. Wolfe
*Attorney, Agent, or Firm*—Martin A. Farber

[57] ABSTRACT

The invention relates to a cylinder-lock having a flat key comprising a shank having at least one profile longitudinal groove extending from the end thereof to accommodate a rib in the key-channel of the cylinder-lock, said shank including fixed key bits adapted to index pin-tumblers in the cylinder-lock, said key including in the area of the wide side of the shank an additional movable key bit, said movable key bit being adapted to be controlled by a shoulder in the key-channel such that when the key is inserted it induces an auxiliary tumbler into a position which allows the cylinder core of the lock to be rotated.

10 Claims, 15 Drawing Figures

E
19
18
13
17
11
20
Z
2
3
35
21
22
23
24
25
26
31
27
32
34
33
28
29
F
8'
8''
15
6
8
7
1
9

CYLINDER-LOCK WITH FLAT KEY

In known designs of this kind (U.S. Pat. No. 1,735,868), a dog constituting a movable key bit is in the form of a double lever adapted to pivot about an axis. The rear edge of the double lever projects laterally beyond the wide side of the key and is curved convexly. In the terminal-insertion position, this curved rear edge moves into engagement with a shoulder in the key-channel, which causes one tip of the double lever to be displaced laterally of the opposite wide side of the key, to enter the bore of an auxiliary tumbler and move the latter to a released position making it possible for the cylinder core to rotate. From the production point of view, this solution has disadvantages, more particularly because the double lever, which is a precision casting, is relatively complex in shape. There are also considerable operational disadvantages. Since the double lever, even in its basic setting, projects considerably beyond one side of the key, it is impossible to stack a plurality of keys one on top of the other in a flat position. There is also always a danger of the movable bit swinging out when the key is put away and then being damaged. To this extent, the key is not suitable for a key-ring. In order to achieve the required durability, the movable bit must be made of a material of considerable thickness. This, however, increases the size of the key and it is impossible to keep it within the normal commercial dimensions. The result of this is that many of the profiled grooves in the lateral surface of the key must be omitted, which impairs the reliability of the lock and narrows its usefulness in master-key installations and centralized-lock installations. Furthermore, this known design requires a widened key-channel to accommodate the movable key bit and this widening must extend as far as the outlet end of the key-channel and is located on the side from which the control forces are applied to the movable bit. This reduces the resistance of the lock to manipulation by a tool inserted into the key-channel. It also has the disadvantage that, even when the key is fully inserted the movable bit may still be reached by a tool inserted into the unoccupied part of the key-channel cross-section. Thus, even when a key having a movable bit not matched to the corresponding cylinder-lock, is inserted for example, one of smaller dimensions, the movable bit can be pivoted by such a tool into a position corresponding to the release of the auxiliary tumbler. The security-value of the key is thus very low.

It is the purpose of the invention to provide a configuration of this kind such that the production of the key is simplified, it is more convenient to use, and wherein when the key is inserted the movable bit cannot be displaced by manipulating or lock-picking tools, in the direction of the auxiliary tumbler.

The invention provides a cylinder-lock having a flat key comprising a shank having at least one profiled longitudinal groove extending from the end thereof to accommodate a rib in the key-channel of the cylinder-lock said shank including fixed key bits, adapted to index pin-tumblers in the cylinder-lock, said key including in the area of the wide side of the shank an additional movable key bit, said movable key bit being adapted to be controlled by a shoulder in the key-channel such that when the key is inserted it induces an auxiliary tumbler into a position which allows the cylinder core of the lock to be rotated, said movable key bit comprising a rolling element movably retained within a transverse opening in said shank located in the lateral wall of said profile longitudinal groove, said rolling element having a diameter which is greater than the thickness of the material of the shank in the vicinity of said opening such that said rolling element at all times projects laterally beyond said opening on at least one side.

This design provides a cylinder-lock, with flat key, of increased serviceability, simplified manufacture, and greater security. The use of a rolling element, for example a sphere, as the movable key bit simplifies production, since this component is of simple geometrical design which can be produced, at no great cost, with considerable precision and in graded dimensions. The rolling effect ensures, in practice, that there will be no increase in friction during insertion and removal of the key. Since there are no parts which can pivot out of the wide side of the key, the key according to the invention is more easily stored. There is little danger of wear, even after long periods of use.

There is no need to dispense with any of the profiled grooves in the key. The fact that the rolling element is arranged in the vicinity of a profiled groove, and is larger in diameter, in this area, than the thickness of key, means that the projecting rib provided in the key-channel which, in known fashion, fits positively into the profiled groove in the key, performs a controlling function. The free transverse displaceability of the rolling element in the key makes it possible to shift the rolling element into its operative position over a very short distance.

In the fully inserted position of the key, the rolling element cannot be shifted by any lock picking or manipulating tools, to achieve additional transverse lift. Thus the effective lift of the rolling element cannot be influenced from the outside. The undulating pattern of the key-channel section, made possible by the transverse displaceability of the rolling element, produces a certain monitoring scanning thereof as soon as the key is inserted. If the diameter of the rolling element is too large, it cannot be passed through this undulating section. Such a key is prevented from entering even before the rolling element can reach its operative position at the auxiliary tumbler. On the other hand, if the rolling element is too small, although the key would not be prevented from entering, it would not shift the auxiliary tumbler into the indexed or released position and, because of its inaccessibility, it could not be shifted further, by the required amount, by an inserted manipulating tool.

The wave-shaped pattern optimizes the hidden position of the rolling element. Even on the wide side of the key, opposite the profiled groove by which the rolling element is controlled there is no linear path for inserting a manipulating tool. In the fully inserted position of the key, the rolling element lies fully upon the end-surface of the projecting zone, so that, in the longitudinal direction of the key and the lock, it is possible to work to larger tolerances, thus simplifying production, without impairing security. In this connection, the length of the projecting zones preferably corresponds to the diameter of the rolling element. The small size of possible rolling elements, more particularly spheres, and the compact way in which they are fitted, makes it possible even to provide several rolling elements in one key, without increasing the size of the key. The special wave-shaped pattern permits simple production by milling, so that instead of the usual linearly milled key-channel, only a partial external area needs to be milled in wave-shape. Control of the auxiliary tumbler by means of a detent and cam makes it possible to operate with small transverse displacements. In this connection, the special configuration, mounting, and method of operation of the detent and cam described herein is structurally advantageous, especially as regards maintaining the necessary accuracy.

Instead of a sphere, it would also be possible to use a cylindrical rolling element, for example with a cambered end-face. Producing the wave-shaped pattern in the key-channel section with corresponding stationary pins, arranged in the cylinder core, is not only advantageous from the production point of view, but also makes possible many simple variations in assembling the cylinder-lock. Above all, it allows the wave-shaped pattern to be produced at any level in the key-channel. Flattening the inner ends of such pins makes it possible to use pins of which the remaining sections are larger in cross-section than the internal width of the longitudinal profiled groove. Designing such pins as mushroom head pins, which position themselves merely by abutment, again greatly simplifies assembly and even makes it possible to change, at a later date, to pins of a different length, for example. If it is desired to manage with the smallest possible number of pins, this is achieved, as indicated, in that the inner end of a pin is associated with a recess in the opposing channel-wall. The entry and exit edges of the recess are then located, in relation to the free internal edge-sections of the pin travelled over by the rolling element, so that this internal dimension corresponds approximately to the diameter of the rolling element running in this direction.

In the case of flat keys, it is known to include spheres. (U.S. Pat. No. 3,877,267). In this case, however, the spheres are stationary and serve merely to reduce wear in the key in the vicinity of the key bits controlling the tumblers. Furthermore, they are exposed on only one side of the key. This makes it impossible to apply a force, as in the case of the invention, to the sphere on one wide side of the key, for the purpose of obtaining a control-force on the other wide side of the key, from the surface of the sphere emerging therefrom.

A number of embodiments of the invention will be explained hereinafter by way of example only, in conjunction with the drawings attached hereto, wherein.

Figure 1:
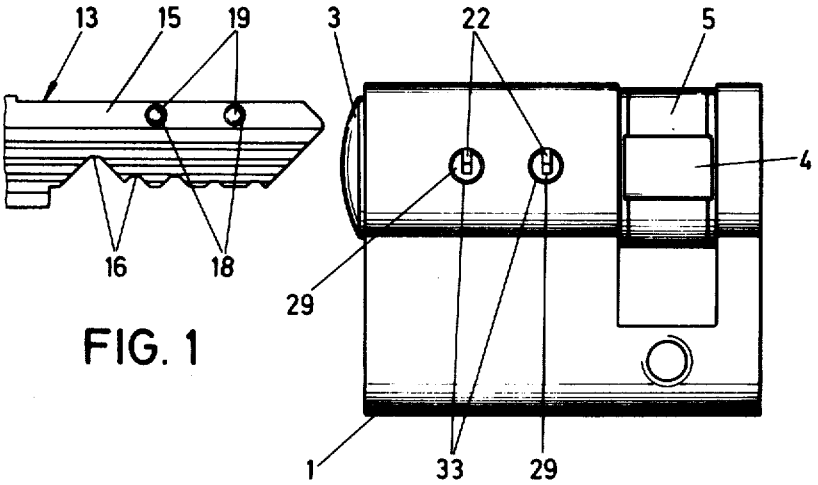
FIG. 1 is a view of the shank of a flat key before insertion into the relevant cylinder-lock according to a first embodiment.
Figure 2:
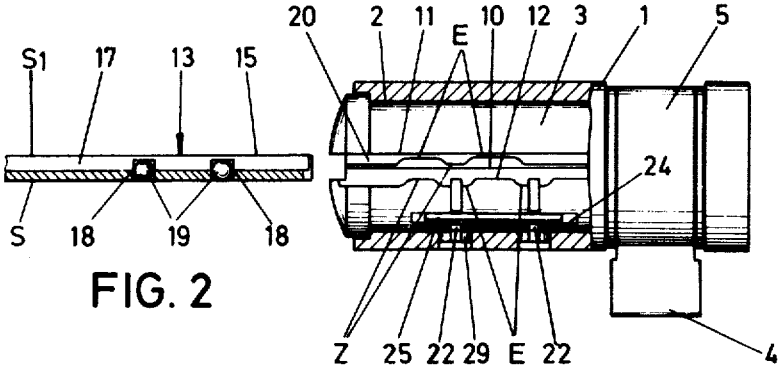
FIG. 2 is a horizontal section through the shank of the key in the area of the bearing locations accommodating the spheres, showing a partially sectioned cylinder-lock, also prior to insertion of the key.
Figure 3:
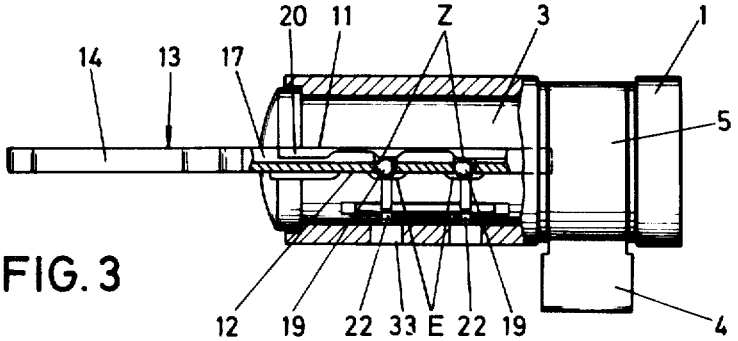
FIG. 3 is a view similar to FIG. 2, but with the flat key inserted.
Figure 4:
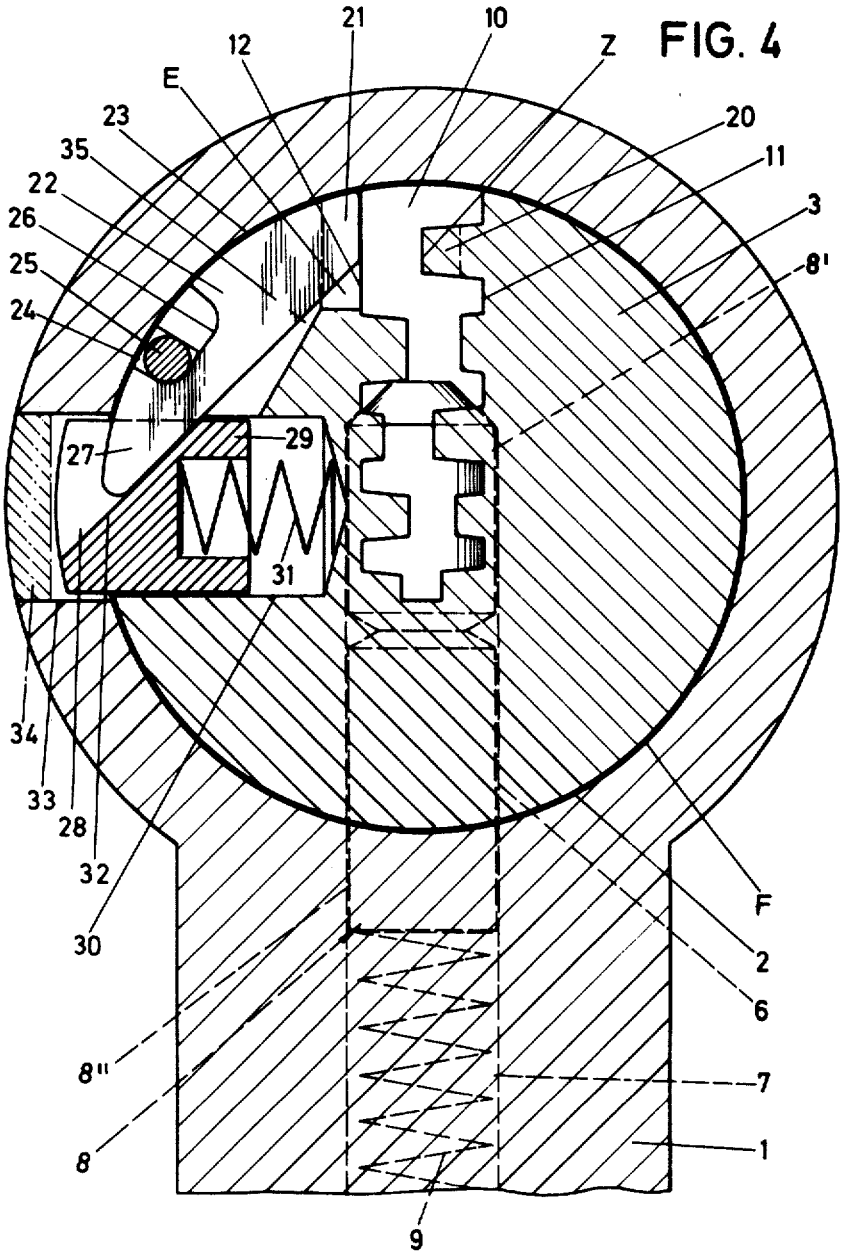
FIG. 4 is a greatly enlarged cross-section through the cylinder-lock with the key not inserted, in the area of an additional tumbler.
Figure 5:
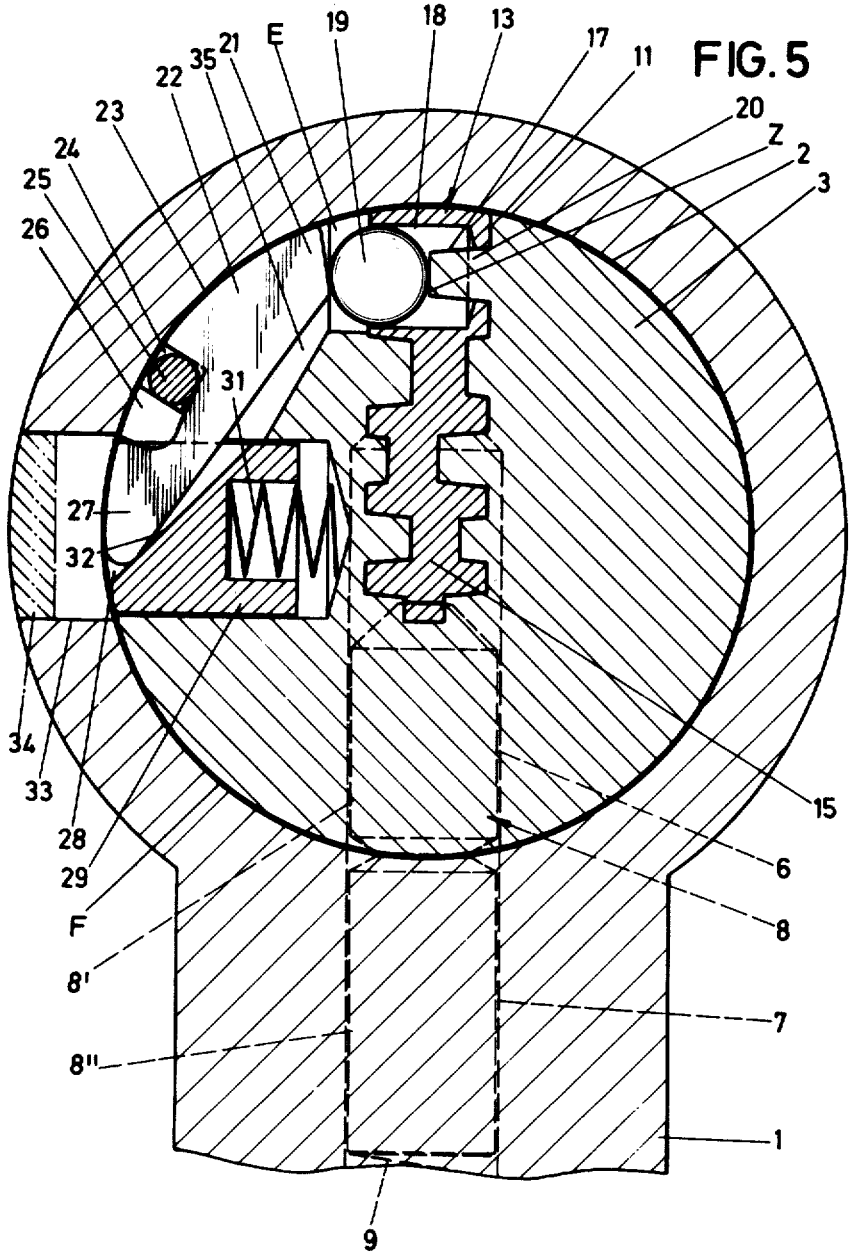
FIG. 5 is a view similar to FIG. 4, but with the key inserted and the additional tumbler shifted into the release position.

Referring to FIGS. 1 to 5 the cylinder-lock has a profiled locking-cylinder-housing 1, with a cylinder core 3 mounted rotatably in a bore 2 therein. The core is in connection with, and does not rotate relative to, a hub 5 the latter having a locking piece 4.

Cylinder 1 and core 3 have aligned bores 6, 7 (FIG. 5) accommodating tumbler-pins 8 consisting of core-pins 8' and housing-pins 8''. A compression-spring 9 urges the latter towards cylinder core 3.

Running in the longitudinal direction of, and within, the cylinder core 3 is a key-channel 10 having lateral walls 11 and 12 which have projecting ribs which define a cross-sectional profiling of the key-channel 10.

The cross-sectional profile of the key 13 is adapted to that of key-channel 10, the key consisting of a bow 14 and a shank 15. One narrow edge of the shank 15 comprises consecutive notches 16 of varying depths which co-operate with tumbler-pins 8 and index them, when the key is inserted, in such a manner that the junction between the core-pins 8' and the housing-pins 8'' is level with the cylindrical surface F of the cylinder core 3—see FIG. 5.

Located on the narrow edge of the shank 15 remote from notches 16, running at right angles thereto, in the vicinity of the upper, profiled longitudinal groove 17, are bearing bores 18 for the accommodation of movable key bits in the form of spheres 19, these bores opening onto both wide sides S and S1 of the key shank. The spheres 19, the diameter of which is smaller than the thickness of the key, are prevented from falling out of the bores in that the said bores have shoulders just before the wide side S1 and are lightly peened on the opposite side S. However, the spheres remain free to move.

The rib in the lateral channel-wall 11 level with the profiled longitudinal groove 17 in the key 13, bears the reference numeral 20. In conjunction with the opposite lateral wall 12 of the channel, this rib forms a wave-shaped or undulating pattern, projecting zones Z alternating with recesses E. The width of this undulating section corresponds to the diameter of the spheres 19, and the length of the projecting zones Z correspond approximately to the diameter of the spheres 19.

One end of a transmission detent 22 projects into the area of each recess E in the lateral wall 12 of the channel. The detent is accommodated in a transverse slot 3a in the cylinder core 3 and is segmental in shape, such that the curved surface 23 thereof is located in the vicinity of the cylindrical surface F. The detent 22, which is displaceable along this surface F, is retained by means of a wire 25 running in the longitudinal direction of the core and carried in a groove 24 in the surface of cylinder core 3. The wire crosses a recess 26 (FIG. 4) of larger cross-section in the detent 22, open towards the surface F.

The other end 27 of the detent 22 engages in a groove 28 in and additional tumbler 29 which moves in a radial bore 30 at right angles to the key-channel 10 and is urged outwardly by a compression-spring 31. The groove 28 has a sloping base 32 upon which the end 27 of detent 22 bears in such a manner that the outer section of the tumbler 29, extending beyond the end 27, projects into a recess 33 in cylinder housing 1.

With the key not inserted, the tumbler pins 8 and the additional tumblers 29 prevent the rotation of the core in the housing.

When the key 13 is inserted into the key-channel 10 the key-notches 16 index the tumbler pins 8 accordingly, and the spheres 19, arranged linearly one behind the other, pass through the undulating section of the key-channel. The projecting zones Z in the lateral wall 11 of the key-channel enter the groove 17 in the key 13 and urge spheres 19 outwardly, causing them to project beyond adjacent wide side S of the key. The spheres thus act upon the detents 22 which are moved from the position shown in FIG. 4 to that shown in FIG. 5. This causes the ends 27 facing the tumblers 29 to move the tumblers into the unlocking position, i.e. out of the areas of recesses 33 in the cylinder-housing, thus allowing cylinder core 3 to rotate. When the key is removed, the compression springs 31 return the tumblers 29 and detents 22 to their starting positions, shown in FIG. 4.

The key 13 cannot be inserted into the cylinder-lock unless the key-channel thereof has a profiled longitudinal groove of the required undulating pattern in the vicinity of the spheres. If, on the other hand, a key without any spheres is inserted, although it can index the tumbler-pins 8, it will not shift the additional tumblers 29.

The recesses 33 in the cylinder housing are closed off by filler pieces 34.

Instead of the additional tumblers 29 being provided on only one side they could also be provided on both sides of the cylinder core in a staggered arrangement.

Figure 6:
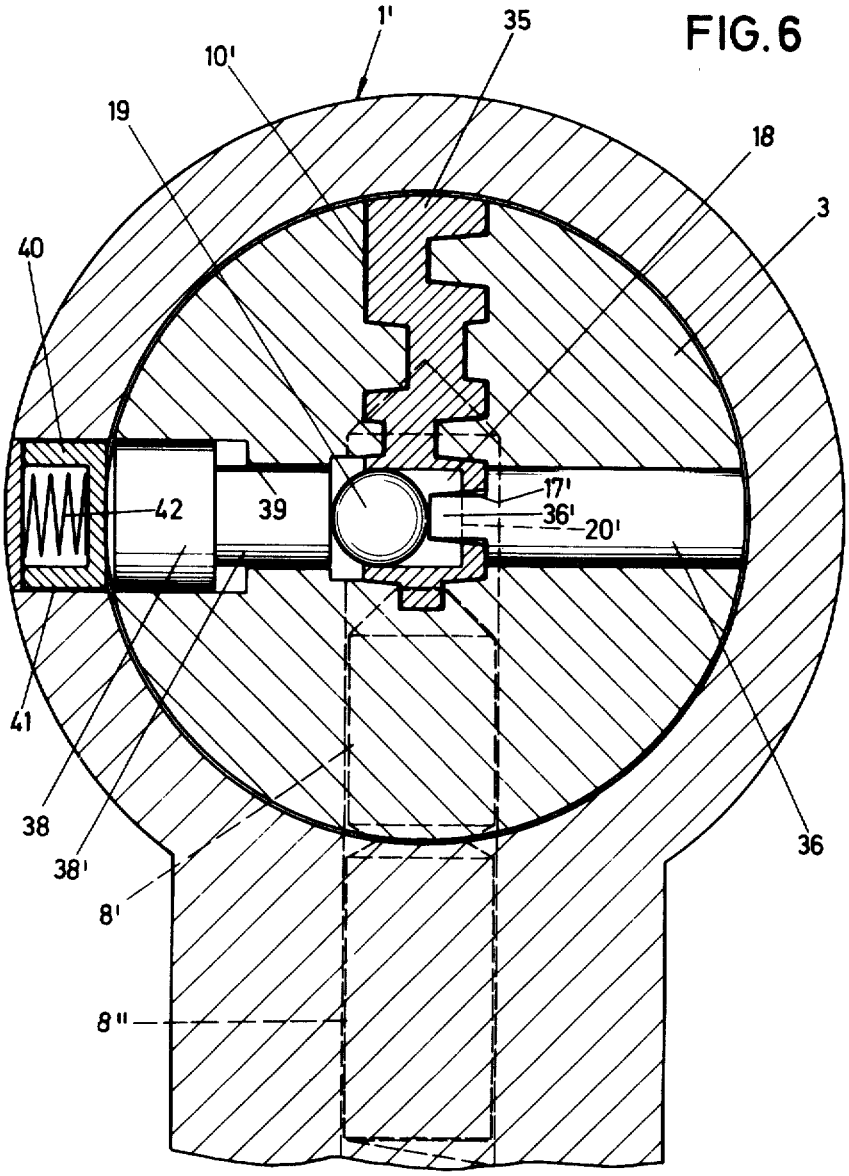
FIG. 6 is a cross-section through a cylinder-lock according to a second embodiment, in which the sphere arranged in the shank of the key controls the additional tumbler directly.
Figure 7:
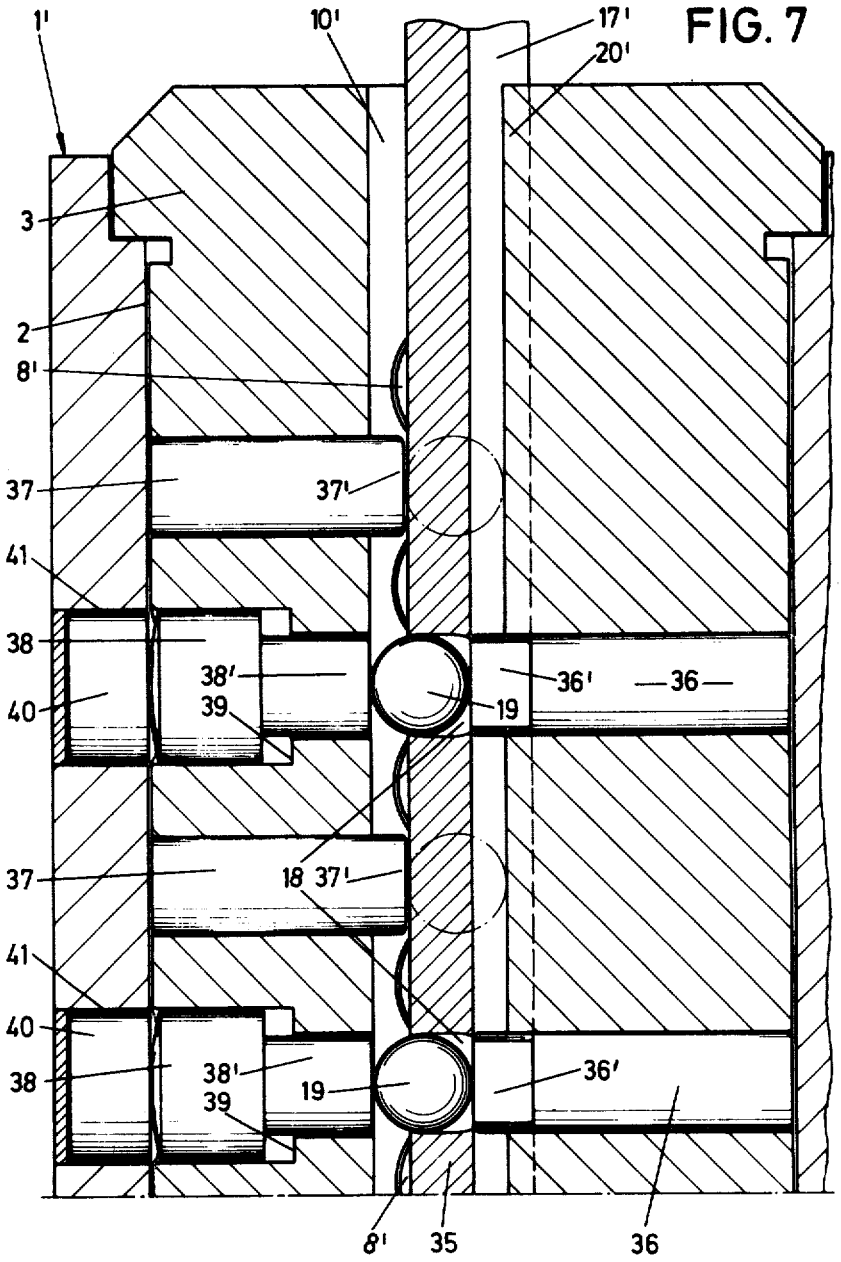
FIG. 7 is a horizontal section through the cylinder-lock of FIG. 6 in the plane of the sphere.

In the embodiment illustrated in FIGS. 6 and 7, bearing bores 18 for the accommodation of spheres 19, are located at the edges of a key 35 adjacent the notches. The arrangement is such that, with key 35 inserted, as shown in FIG. 6 the spheres 19 lie in the horizontal longitudinal centre plane of the cylinder core 3. A rib 20', on the corresponding lateral wall of the channel, projects partly into the groove 17' in the key 35.

Facing the pins 36 are additional pins 37 which are staggered in relation thereto. Free ends 37' of the pins 37 enter the key-channel 10'. The distance between the ends 37' and the opposing surface of the rib 20' corresponds to the diameter of the spheres 19 and largers spheres cannot therefore pass through the key-channel 10'. Thus the pins 36, 37 also define an undulating section of key-channel.

Arranged in opposed alignment to the pins 36 are additional tumblers 38 equipped with stepped shanks 38' and projecting into the key-channel 10'. Movement of the tumblers 38 is limited by a shoulder 39 on the housing side. The additional tumblers 38 are urged inwardly by tumbler-pins 40 on the housing side which are in turn accommodated in closed radial bores 41 in the cylinder housing 1'. The tumbler-pins 40 are pot-shaped and each contains a compression spring 42 in its interior.

If the correct key 35 is inserted into the key-channel 10', the sphere 19 passes through the undulating section of the key-channel formed by the pins 36, 37, urging the additional tumblers 38 outwardly against the action of their springs. When the key is fully inserted; therefore, the junction between the additional tumblers 38 and the tumbler pins 40 lies on the core-rotation cylindrical surface. Since the remaining tumblers 8 are now also indexed, the cylinder core may be turned by key 35. Furthermore, in the fully inserted position, the spheres 19 lie upon the end-faces of pins 36.

Figure 8:
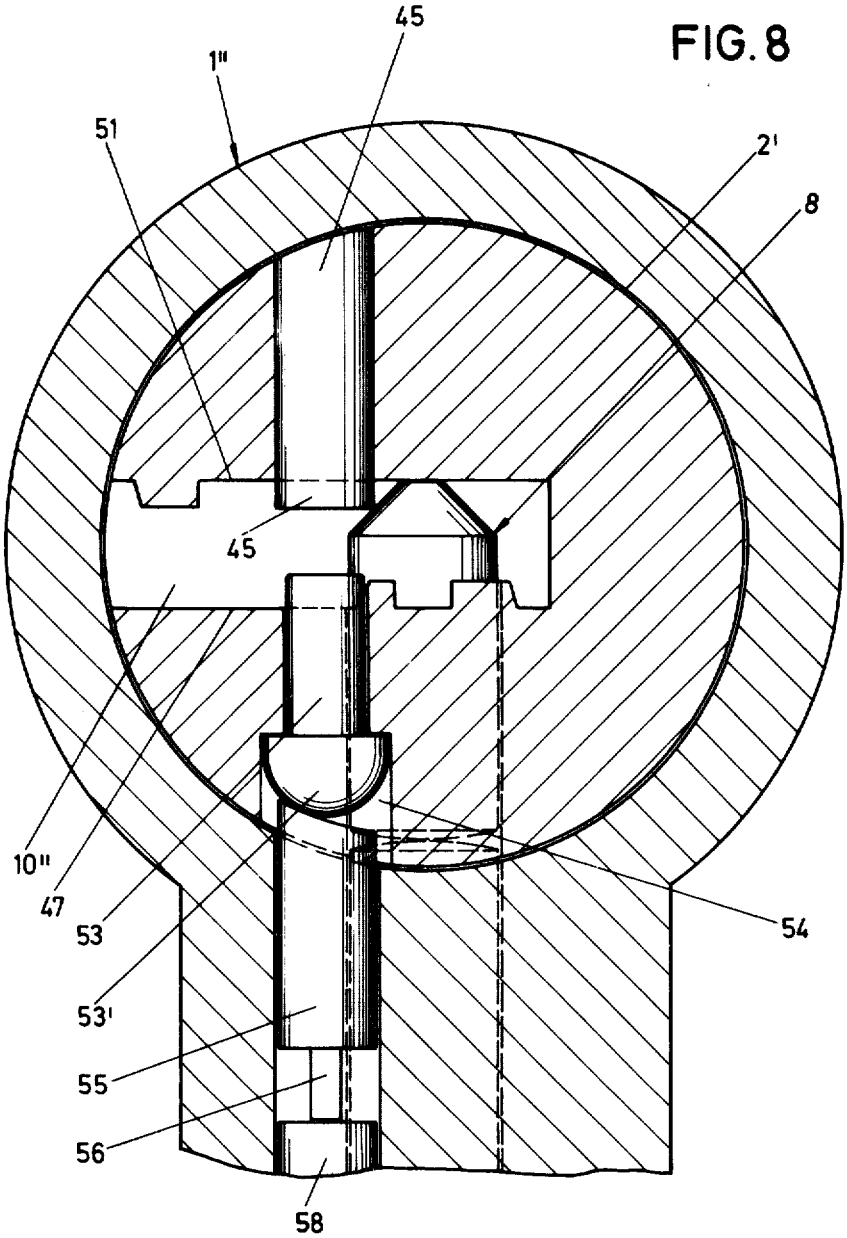
FIG. 8 is a cross-section through a cylinder-lock according to a third embodiment, with the key not inserted, in which the flat key indexes the tumbler pins by means of recesses arranged upon the wide side of the key.
Figure 9:
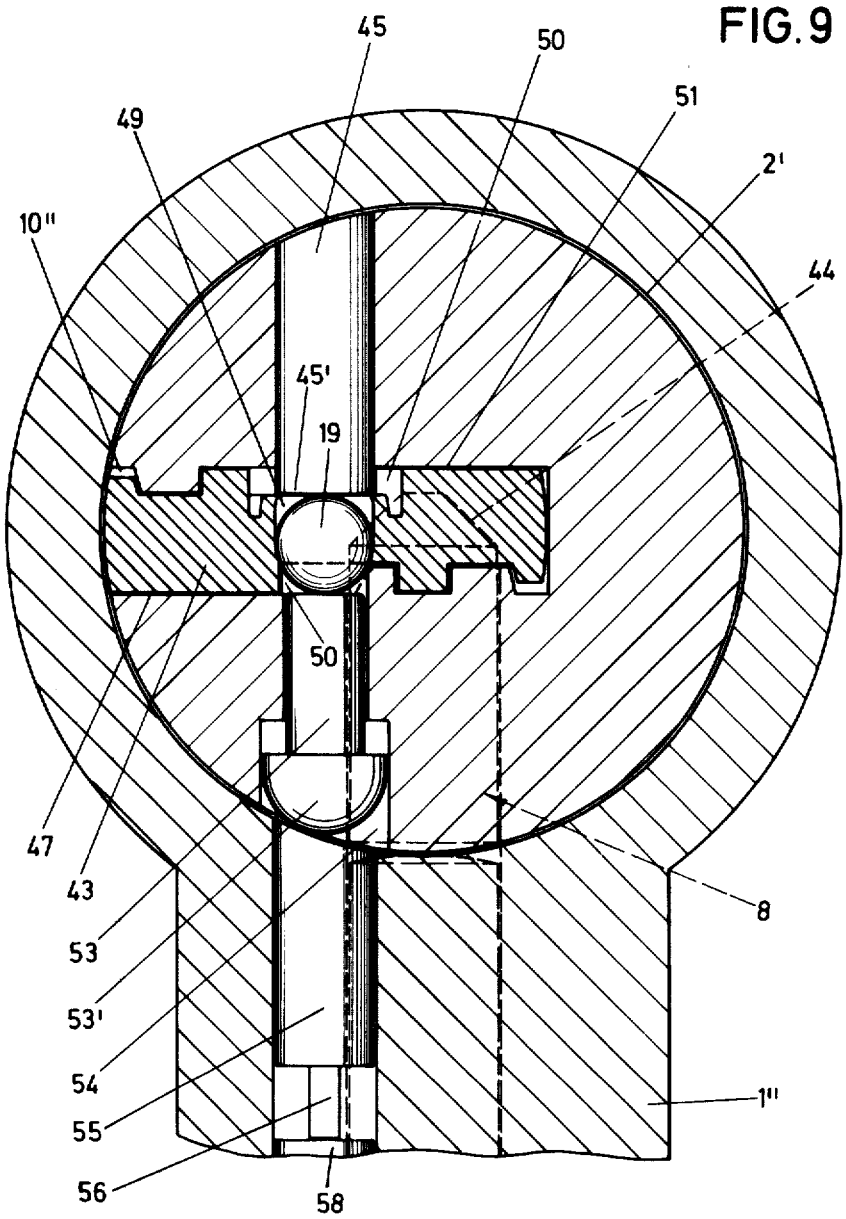
FIG. 9 is a view corresponding that of FIG. 8, but with the key inserted.
Figure 10:
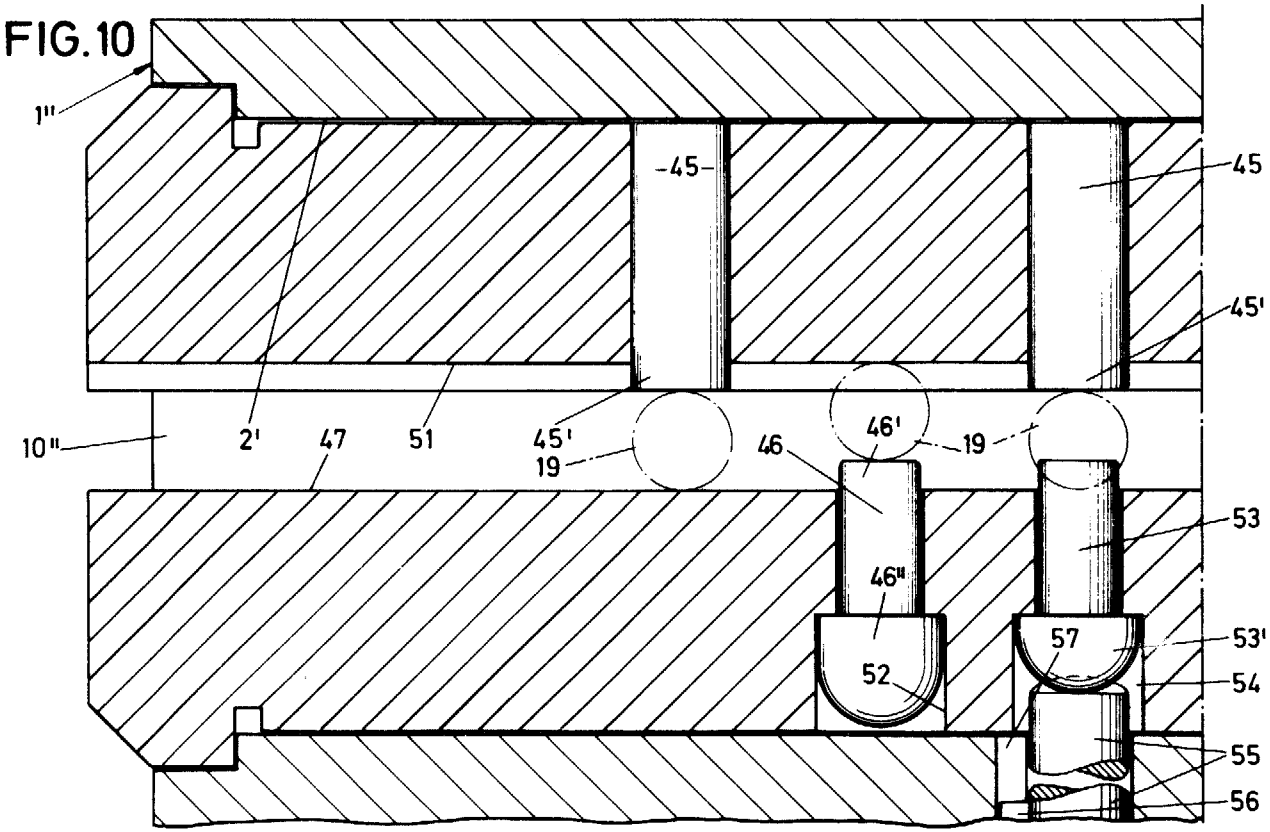
FIG. 10 is a vertical section through the cylinder-lock in the plane of the additional tumbler, with the key not inserted.

The variants illustrated in FIGS. 8 to 10 relate to a cylinder lock in which a key 43 indexes the main tumbler pins 8 by means of recesses 44 arranged in its wide sides. Pins 45, 46, accommodated stationarily in the cylinder core, are arranged parallel with the tumbler pins 8 but with the gaps in effect relationship thereto. Inner ends 45' of the pins 45 also project into the key-channel 10'', in such a manner that the distance between the opposing lateral wall 47 of the channel and inner end 45' corresponds to the diameter of the sphere 19, carried in the shank of key. In the embodiment illustrated, the sphere 19 is accommodated in a bearing bore 49 extending, in the key shank, between two opposing profiled longitudinal grooves 50 therein. Thus the latter may be used as a reversing key. The sphere 19 is thus displaceable and can therefore project beyond the base of either profiled longitudinal groove 50.

Located opposite the pins 45, and between them, is pin 46, the free end 46' of which enters the key-channel 10'' to the extent that the distance between the inner end 46' and the opposing lateral wall 51 of the channel corresponds to the diameter of the sphere 19, as shown in FIG. 10 in dotted lines. The pin 46 is in the form of a mushroom-pin, the head 46'' thereof being accommodated in a pocket bore 52 in the cylinder core and resting upon the inner wall of cylinder core bore 2' in housing 1''. Pocket bore 52 is of a length such that the inner end 46' projects beyond the lateral wall 47 of the channel by a specific amount.

Tumbler 53, located after the mushroom-pin 46 in the direction of insertion, is also in the form of a mushroom-pin. The head 53' thereof is located in a pocket bore 54 in the cylinder core and is acted upon by a non-rotatable housing pin 55. The latter is equipped with a radially projecting tongue 56 guided in a groove 57 extending away from the bore in the housing. A spring-loaded housing pin 58 bears upon the tongue 56. This urges the housing pin 55 into the pocket bore 54 and displaces the tumbler 53 in such a manner that it projects into the key-channel 10''.

Now if, as shown in FIG. 9, the key 43 is inserted into the key-channel 10'', the sphere 19 travels through the undulating section of the channel formed by the pins 45, 46.

In the fully inserted position, the sphere 19 then displaces the tumbler 53 to an extent such that the junction between it and the housing-pin 55 lies upon core-rotation surface F.

Figure 11:
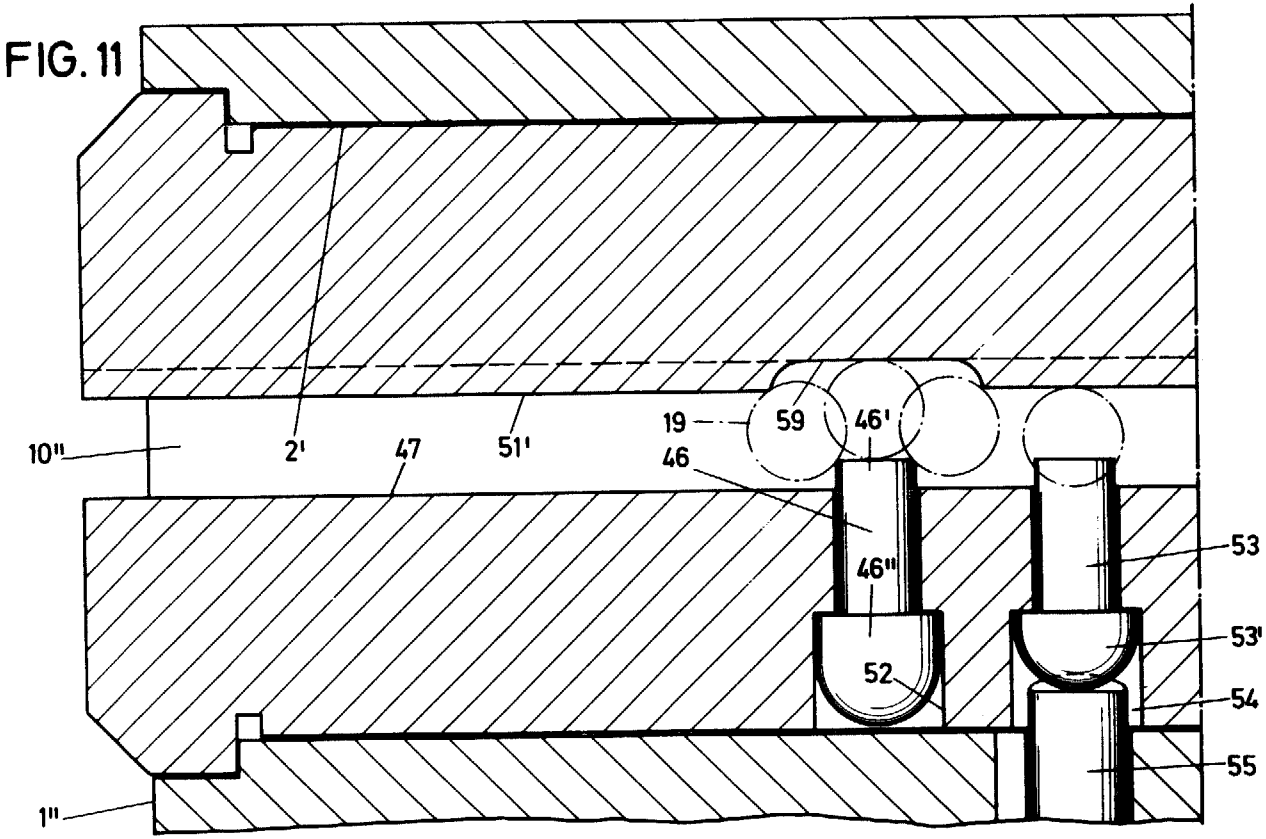
FIG. 11 is a section corresponding to that shown in FIG. 10, a recess in the opposing wall of the channel being associated with the end of a pin.

In the embodiment illustrated in FIG. 11, the same tumbler 53 is used, and is preceded, on the same side of the key-channel 10'', by a mushroom-pin 46. The channel-wall 51' facing the inner end 46' of pin 46 is equipped with a recess 59 the distance between the bottom of the recess 59 and the end 46' of mushroom-pin 46 corresponding to the diameter of the sphere 19. Thus, the recess 59 in conjunction with the pin 46, forms an undulating path adapted to the diameter of rolling element 19.

Figure 12:
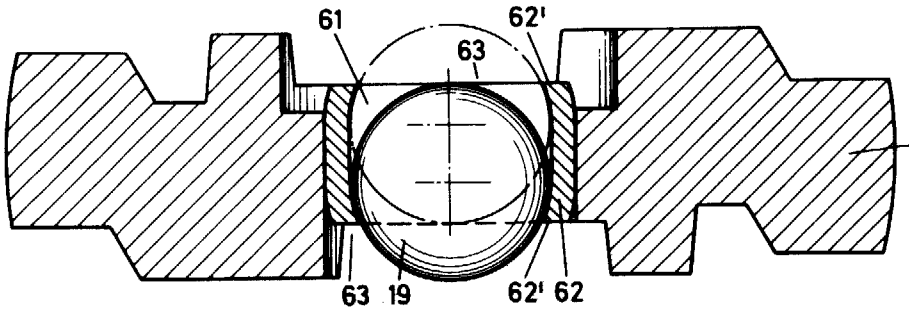
FIG. 12 is a cross-section, to a greatly enlarged scale, through the shank of such a key which indexes the tumbler-pins by means of recesses located on its wide sides.
Figure 13:
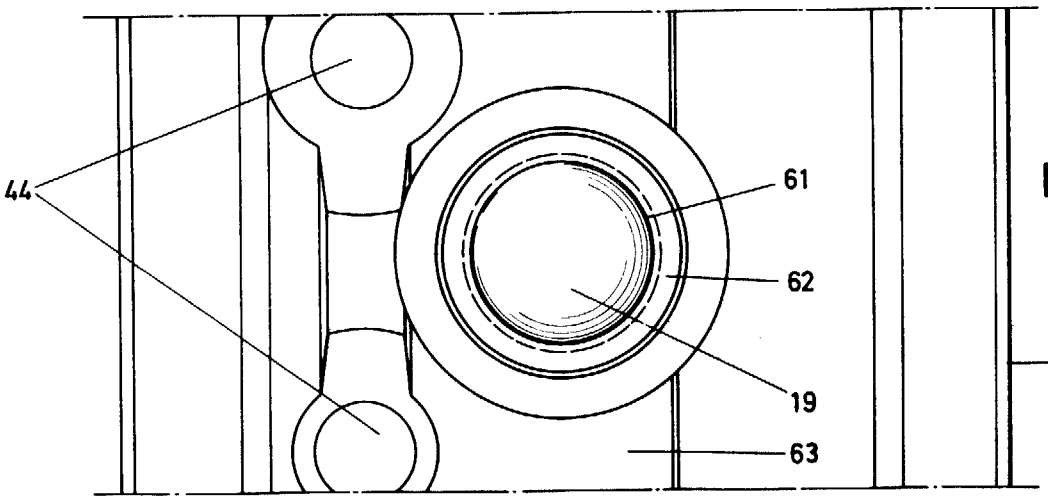
FIG. 13 is a plan view of FIG. 12.

In the variants of key 60 illustrated in FIGS. 12 and 13, the wide sides of the key also index the main tumbler pins. In contrast to the design of key 43 described hereinbefore, a bearing bore 61 is located in a bush 62 which is lightly peened over at both ends and is pressed into an opening in the central area of the key-shank. Profiled longitudinal grooves 63 extend on each side of the bush, in such a manner that the ends 62' of the bush lie flush with the bases of these grooves. As shown in FIG. 12, this makes it possible to displace the sphere 19 from the terminal position shown in full lines to the terminal position indicated in dotted lines. This is again achieved by the pins or projections in the key-channel projecting into profiled longitudinal grooves 63.

It may be seen from FIG. 13 that rolling element 19 is offset in relation to the line of consecutive recesses 44.

Figure 14:
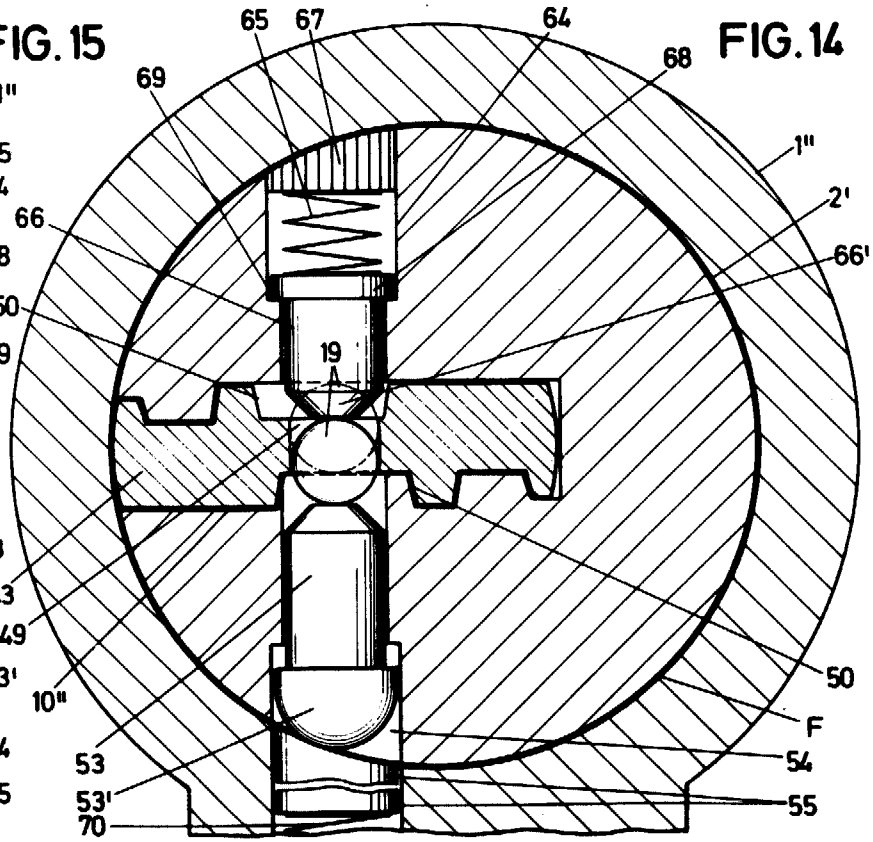
FIG. 14 is a cross-section through a cylinder-lock according to a fourth embodiment, with the key inserted.
Figure 15:
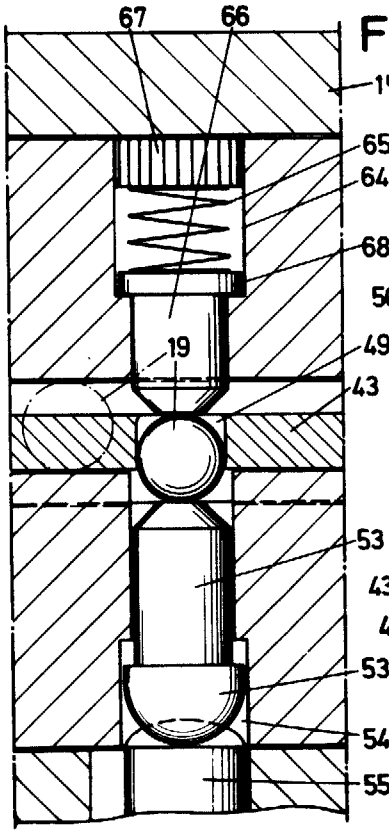
FIG. 15 is a vertical section through this cylinder-lock of FIG. 4 in the plane of the additional tumbler.

Similar parts in the cylinder-lock illustrated in FIGS. 14 and 15 bear the same reference numerals as the design in FIGS. 8 to 10. Facing the tumbler 53, which is also mushroom-shaped, and in alignment therewith, in a stepped bore 64, is a control pin 66 acted upon by a compression spring 65 and forming the projecting zone. The other end of spring 65 bears upon a plug 67 which closes off the bore 64 and conforms externally to the core-rotation surface F. Control pin 66 is provided with a collar which faces towards spring 65 and bears upon a step 69 in bore 64. Thus the free end 66' of the control pin 66 can project into the key channel 10'' by only a specific amount.

As shown in dotted lines in FIGS. 14 and 15, the height of the key channel 10'', in the area of the linear passage for the sphere 19, corresponds to the diameter of the latter. In contrast to control-pin 66, the mushroom-tumbler 53 is guided in such a manner that the mushroom-head 53' prevents the tumbler 53 from entering key-channel 10''.

Now if the key 43 is inserted in the key-channel 10'' in this cylinder-lock, the sphere 19 entering the groove 50 in the key, passes through the linear passage which matches it in size, and acts upon the control pin 66 just before it reaches the fully inserted position, and the pin 66 shifts against the force of the compression spring 65. In the fully inserted position, the control-pin 66 is then aligned with the sphere 19 and the bearing bore 49 allowing the pin to press the sphere 19 towards the tumbler 53. Since the compression spring 70 acting upon housing-pin 55 is weaker than the spring acting upon control-pin 66, the tumbler 53 is displaced by the sphere 19 and the control-pin 66 in such a manner that the junction between the tumbler 53 and the housing-pin 55 lies upon the core-rotation surface F. Thus the pin 66 also serves to close off bearing bore 49, which prevents unauthorized manipulation of tumbler 53 from the outside.

I claim:

1. For a cylinder lock a flat key comprising a shank having at least one profile longitudinal groove extending from an end thereof to accommodate a rib in a key channel in a cylinder core of the cylinder lock, said shank including fixed key bits adapted to index tumbler pins in the cylinder lock, said flat key in an area of the wide side of the shank including an additional key bit formed from a movable member, said movable, additional key bit being adapted to be controlled by a shoulder in the key channel such that when the key is inserted said additional key bit moves an auxiliary tumbler into a position which allows the cylinder core of the lock to be rotated, the improvement wherein the shank is formed with a transverse opening in a lateral wall of said profile longitudinal groove, said additional key bit comprises a rolling element movably retained within said transverse opening in said shank, said rolling element has a diameter which is greater than the thickness of the material of the shank in the vicinity of said opening such that said rolling element at all times projects laterally beyond said opening on at least one side of the key.

2. The flat key according to claim 1, wherein said diameter of said rolling element corresponds approximately to the internal width of a corresponding section of the key channel, said section is formed undulating in the longitudinal direction of the key channel in a part of said section preceding the auxiliary tumbler as viewed in the direction of insertion.

3. The flat key according to claim 1, including a plurality of said rolling elements are disposed in linear arrangement one behind the other, cooperating with a corresponding number of said auxiliary tumblers, respectively.

4. The flat key according to claim 2, wherein the undulation of said section constitutes projecting zones in one lateral wall of the channel and matching recesses formed in another lateral wall of the channel.

5. The flat key according to claim 4, wherein said projecting zones have end faces, said rolling element is aligned with said end face of one of said projecting zones when the key is inserted in the channel, said end faces of said projecting zones are parallel to the longitudinal direction of the channel.

6. The flat key according to claim 1, further comprising means for spring biasing said auxiliary tumbler, the latter being formed with a groove having an inclined bottom, a cylinder housing has a cylindrical bore defining a cylindrical surface in which said cylindrical core is rotatably mounted, said cylindrical bore and said cylinder core have rotatably engaging cylindrical surfaces, said cylinder housing is formed with a recess adjacent said auxiliary tumbler, said cylinder core is formed with a transverse slot in a vicinity of said cylindrical surface of said core, detent means for controlling the auxiliary tumbler via said rolling element, said detent means is mounted in said transverse slot, said detent means is formed as a circular section engaging said cylindrical surface of said housing and adapted to be engaged at one end thereof by said rolling element and shifted such that the other end of said detent means controls said auxiliary tumbler in a direction against biasing of said spring biasing means towards an indexed position of said auxiliary tumbler, said other end of the detent means engages in said groove in said auxiliary tumbler against said inclined bottom, said other end of said detent means in a locked condition of the cylinder lock projects outwardly of the cylinder core into said recess formed in the cylinder housing.

7. The flat key according to claim 2, wherein the undulation of said section comprises pins fixedly mounted in the cylinder core and having free inner ends projecting into the key channel, said pins being offset in relation to each other in the direction of insertion of the key.

8. The flat key according to claim 7, wherein said inner ends of said pins are flat.

9. The flat key according to claim 7, further comprising a cylinder housing has an inner wall defining a cylindrical bore in which said cylinder core is rotatably disposed, said cylinder core has at least one pocket bore adjacent said inner wall, another pin has a configuration of a mushroom pin having a head thereof located in said pocket bore of the core, an outer end of said head engages said inner wall of said cylinder housing.

10. The flat key according to claim 9, wherein said cylinder core defines spaced channel walls defining said key channel therebetween, said pocket bore is formed in one of said channel walls, the other of said channel walls is formed with a recess opposite said pocket bore, said another pin has another projecting into said key channel towards said recess.

* * * * *